US009193059B2

(12) United States Patent
Lombardi et al.

(10) Patent No.: US 9,193,059 B2
(45) Date of Patent: Nov. 24, 2015

(54) HAMMER WITH BEND RESISTANT HANDLE

(71) Applicant: STANLEY BLACK & DECKER, INC., New Britain, CT (US)

(72) Inventors: Keith M. Lombardi, Avon, CT (US); Joshua A. Brown, New Haven, CT (US)

(73) Assignee: STANLEY BLACK & DECKER, INC., New Britain, CT (US)

( * ) Notice: Subject to any disclaimer, the term of this patent is extended or adjusted under 35 U.S.C. 154(b) by 247 days.

(21) Appl. No.: 14/025,314

(22) Filed: Sep. 12, 2013

(65) Prior Publication Data

US 2015/0068366 A1 Mar. 12, 2015

(51) Int. Cl.

| | |
|---|---|
| ***B25G 1/10*** | (2006.01) |
| ***B25D 1/00*** | (2006.01) |
| ***B25D 1/04*** | (2006.01) |

(52) U.S. Cl.

CPC .. *B25G 1/10* (2013.01); *B25D 1/00* (2013.01); *B25D 1/04* (2013.01)

(58) Field of Classification Search

CPC ..... B25D 1/00; B25D 1/04; B25G 1/10

See application file for complete search history.

(56) References Cited

U.S. PATENT DOCUMENTS

| | | | | |
|---|---|---|---|---|
| 2,729,253 | A * | 1/1956 | Marsh | 81/22 |
| 2,837,381 | A * | 6/1958 | Sarlandt | 403/263 |
| 8,534,643 | B2 * | 9/2013 | Lombardi et al. | 254/26 R |
| 2013/0126808 | A1 | 5/2013 | Lombardi et al. | |

* cited by examiner

*Primary Examiner* — David B Thomas

(74) *Attorney, Agent, or Firm* — Pillsbury Winthrop Shaw Pittman LLP

(57) ABSTRACT

A hammer that includes a handle and a head is provided. The handle has a bottom end, an upper portion, and a longitudinal axis extending in a swing plane of the hammer. The head is disposed on the upper portion of the handle. The head has a strike face, and the strike face has a longitudinal axis extending in the swing plane of the hammer. A majority of the longitudinal length of the handle has a longitudinal projection on a first side of the handle and a longitudinal recess on a second side of the handle opposite the first side. The first side of the handle and the second side of the handle generally face opposite directions that are perpendicular to the swing plane.

16 Claims, 13 Drawing Sheets

HAMMER WITH BEND RESISTANT HANDLE

BACKGROUND

Field

The present patent application relates to hammers and more particularly to a hammer having a bend resistant handle.

Conventional hammers typically include a head fixedly secured to or integrally formed with a handle. During use, a striking surface disposed on the head of the hammer is configured to strike against an object, such as a nail or chisel.

Claw hammers, or hammers with a nail slot for removing nails, are used to remove nails in two ways. One way is to engage the nail with the hammer claw and use the curved top of the hammer head as a fulcrum to remove the nail. During this method, the hammer handle is pulled in a plane that the hammer is generally swung (i.e., a swing plane of the hammer) while the hammer head is in contact with a fixed surface. The second way is to engage the nail with the hammer claw and pull the handle in a direction normal to the swing plane (i.e., pull or pivot the hammer handle laterally). This side pulling method often generates mechanical advantage and is useful for removing large or deeply embedded nails. The hammer handle is typically designed for strength in the swing plane. Thus, removing nails using this side pulling method may cause the handle or shaft to flex or bend and put the handle or shaft under stress.

Hammers with a solid steel shaft or handle often have the most noticeable amount of flex or bend in the lateral direction. The steel shaft of the hammer is often designed to be thin so as to reduce the overall weight of the hammer. However, to increase the lateral stiffness in the steel shaft, the width of the hammer shaft may generally be increased. Also, cross-sectional shapes like an I-beam or a dog bone may sometimes be used for the hammer shaft to increase the lateral stiffness of the hammer steel shaft.

SUMMARY

One aspect of the present patent application provides a hammer that includes a handle and a head. The handle has a bottom end, an upper portion, and a longitudinal axis extending in a swing plane of the hammer. The head is, disposed on the upper portion of the handle. The head has a strike face, and the strike face has a longitudinal axis extending in the swing plane of the hammer. A majority of the longitudinal length of the handle has a longitudinal projection on a first side of the handle and a longitudinal recess on a second side of the handle opposite the first side. The first side of the handle and the second side of the handle generally face opposite directions that are perpendicular to the swing plane.

Another aspect of the .present patent application provides a method of forming a hammer, the hammer having a handle with a bottom end, an upper portion and a longitudinal axis extending in a swing plane of the hammer, and a head disposed on the upper portion of the handle. The method includes forming a longitudinal projection on a first side of the handle and a longitudinal recess on a second side of the handle opposite the first side by displacing an amount of material corresponding to the longitudinal recess from the second side of the handle to the first side of the handle. The longitudinal projection and longitudinal recess are formed for a majority of the longitudinal length of the handle.

Yet another aspect of the present patent application provides a hammer that includes a handle and a head. The handle has a bottom end, an upper portion, and a first side and a second side that generally face opposite directions that are perpendicular to a swing plane of the hammer. The head is disposed on the upper portion of the handle. The first side includes a longitudinal projection on at least a portion thereon and the second side includes a longitudinal recess on at least a portion thereon. At least a portion of the handle has a maximum handle thickness dimension measured in millimeters and an overall handle width dimension measured in millimeters taken at an axis perpendicular to a central longitudinal axis of the hammer. The maximum handle thickness dimension is measured from a surface of the longitudinal projection on the first side to a surface of a portion of the second side on which the longitudinal recess is not disposed. A ratio of the maximum handle thickness dimension to the overall handle width dimension is less than 0.4.

These and other aspects of the present patent application, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the present patent application, the structural components illustrated herein are drawn to scale. It is to be expressly understood, however, that the drawings are for the purpose of illustration and description only and are not intended as a definition of the limits of the present patent application. It shall also be appreciated that the features of one embodiment disclosed herein can be used in other embodiments disclosed herein. As used in the specification and in the claims, the singular form of "a", "an", and "the" include plural referents unless the context clearly dictates otherwise.

DETAILED DESCRIPTION

Figure 1:
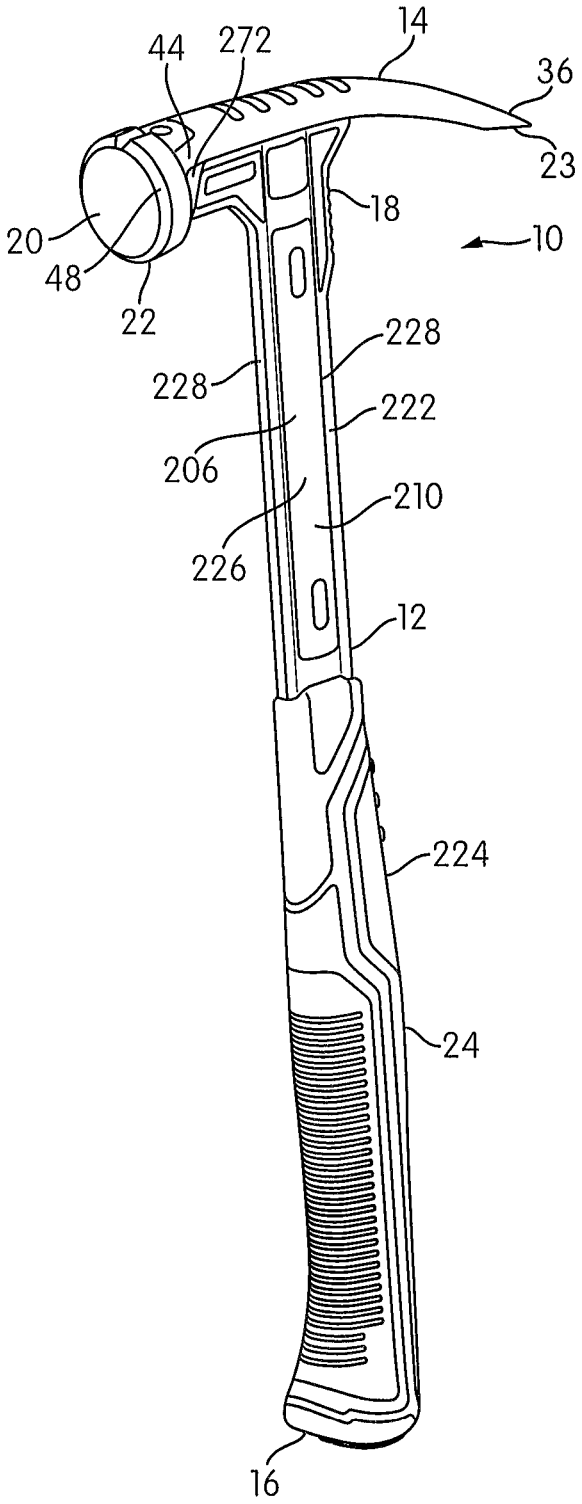
FIGS. 1 and 2 show perspective views of a hammer in accordance with an embodiment of the present patent application, where a hammer gripping portion of the hammer is not shown in FIG. 2 for sake of clarity.
Figure 2:
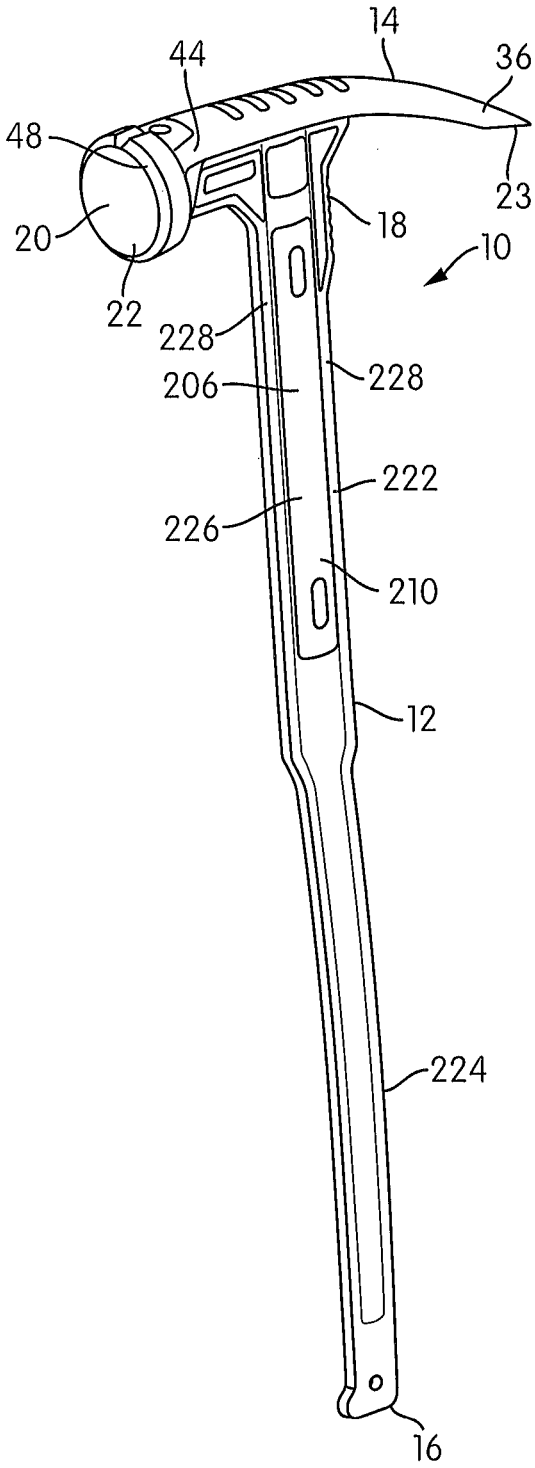

FIGS. 1 and 2 show a hammer 10 in accordance with an embodiment of the present patent application. The hammer 10 includes a handle 12 and a head 14. The handle 12 includes a bottom end 16, an upper portion 18, and a longitudinal axis L-L (as shown in FIGS. 3, 4, 7 and 8) extending in a swing plane SP-SP (as shown in FIGS. 5, 6, 9, 10, 14 and 15) of the hammer 10. The head 14 is disposed on the upper portion 18 of the handle 12. The head has a strike face 20, and the strike face 20 has a longitudinal axis SFL-SFL (as shown in FIGS. 3, 4, 7 and 8) extending in the SP-SP swing plane of the hammer.

In one embodiment, a majority of the longitudinal length of the handle 12 has a longitudinal rib portion 210 on a first side 206 of the handle 12 and a longitudinal recess portion 212 on a second side 214 of the handle 12. In one embodiment, the first side 206 of the handle 12 and the second side 214 of the handle 12 generally face opposite directions that are perpendicular to the swing plane SP-SP. In one embodiment, a majority of the longitudinal length of the handle 12 has the longitudinal rib portion 210 on one side 206 of the swing plane SP-SP and the longitudinal recess portion 212 on the opposite side 214 of the swing plane SP-SP.

Figure 8:
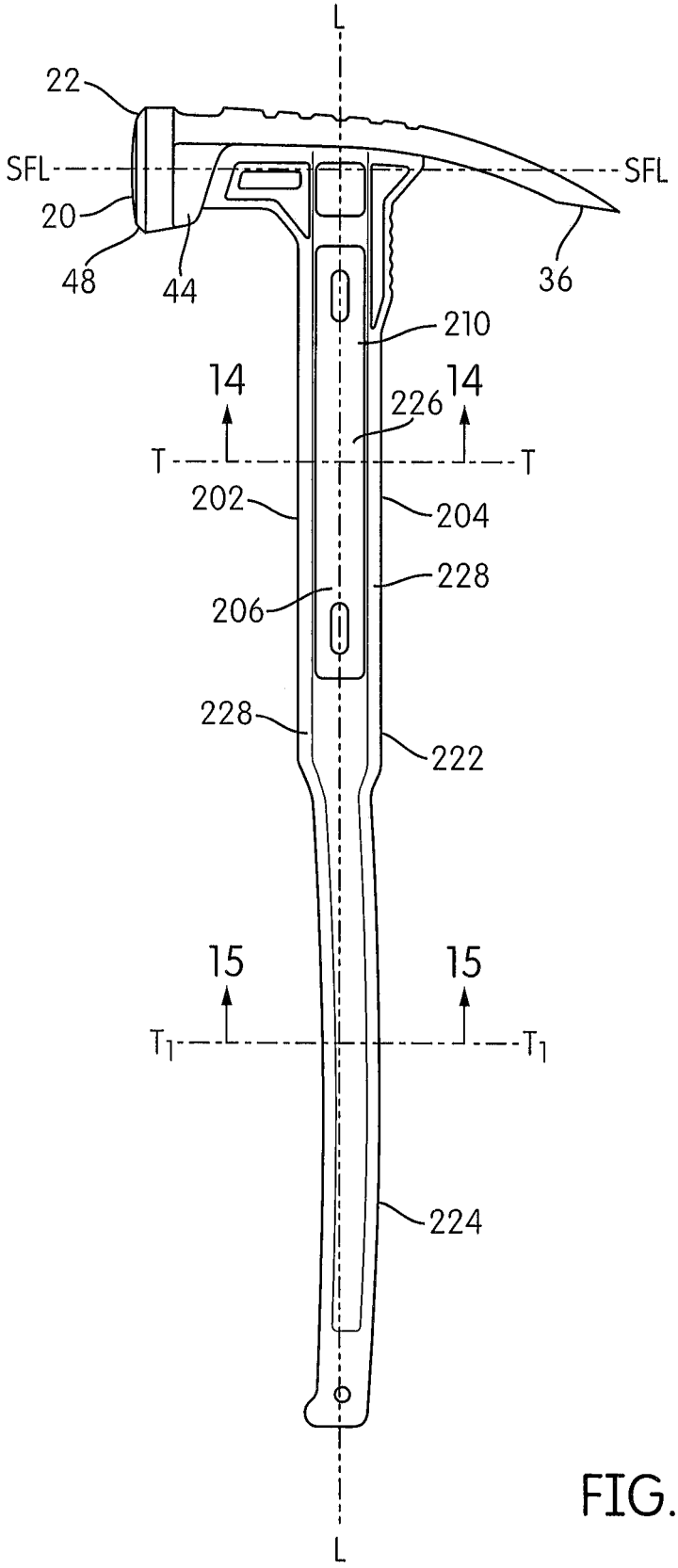
Figure 9:
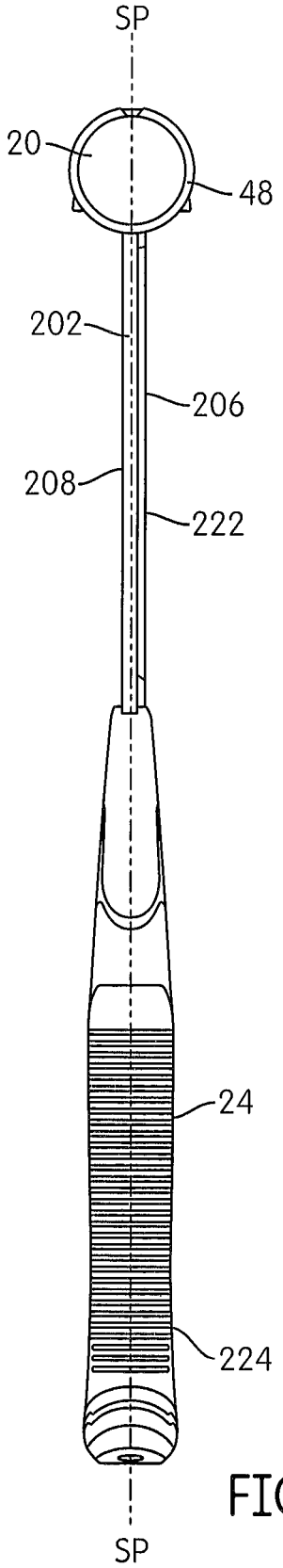
FIGS. 9 and 10 show front elevational views of the hammer in accordance with an embodiment of the present patent application, where the hammer gripping portion of the hammer is not shown in FIG. 10 for sake of clarity.
Figure 10:
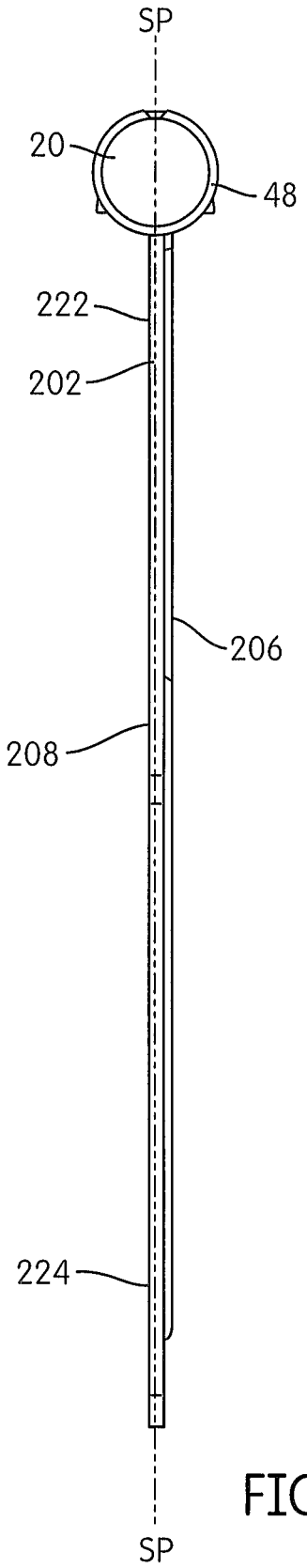

In one embodiment, the rib/recess configuration takes the form of a concavo-convex shaped cross-sectional configuration (shown and described in detail with respect to FIGS. 14 and 15) taken at a plane (e.g., plane T-T or plane $T_1$-$T_1$ as shown in FIG. 8) that is perpendicular to the central longitudinal axis L-L (as shown in FIGS. 3, 4, 7 and 8) of the hammer 10. In one embodiment, as shown in FIGS. 1, 2, 7, 8, 14 and 17, the concavo-convex shaped cross-sectional configuration portion 226 of the handle 12 is flanked by two longitudinal flat areas 228 but other shapes may be used. In one embodiment, the longitudinal flat end portions 228 have opposite parallel sides. In one embodiment, the longitudinal flat end portions 228 are disposed on opposite sides of the longitudinal projection 210 and the longitudinal recess 212.

Figure 14:
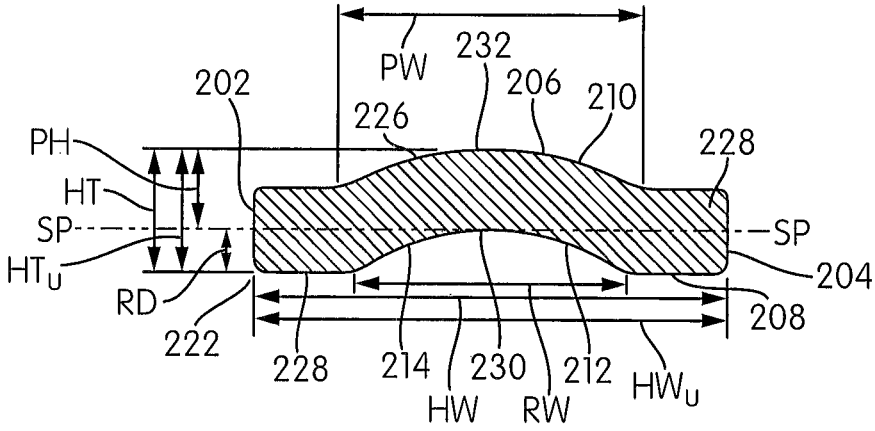
FIG. 14 shows a sectional view of the hammer taken along the line 14-14 of FIG. 8 in accordance with an embodiment of the present patent application.
Figure 17:
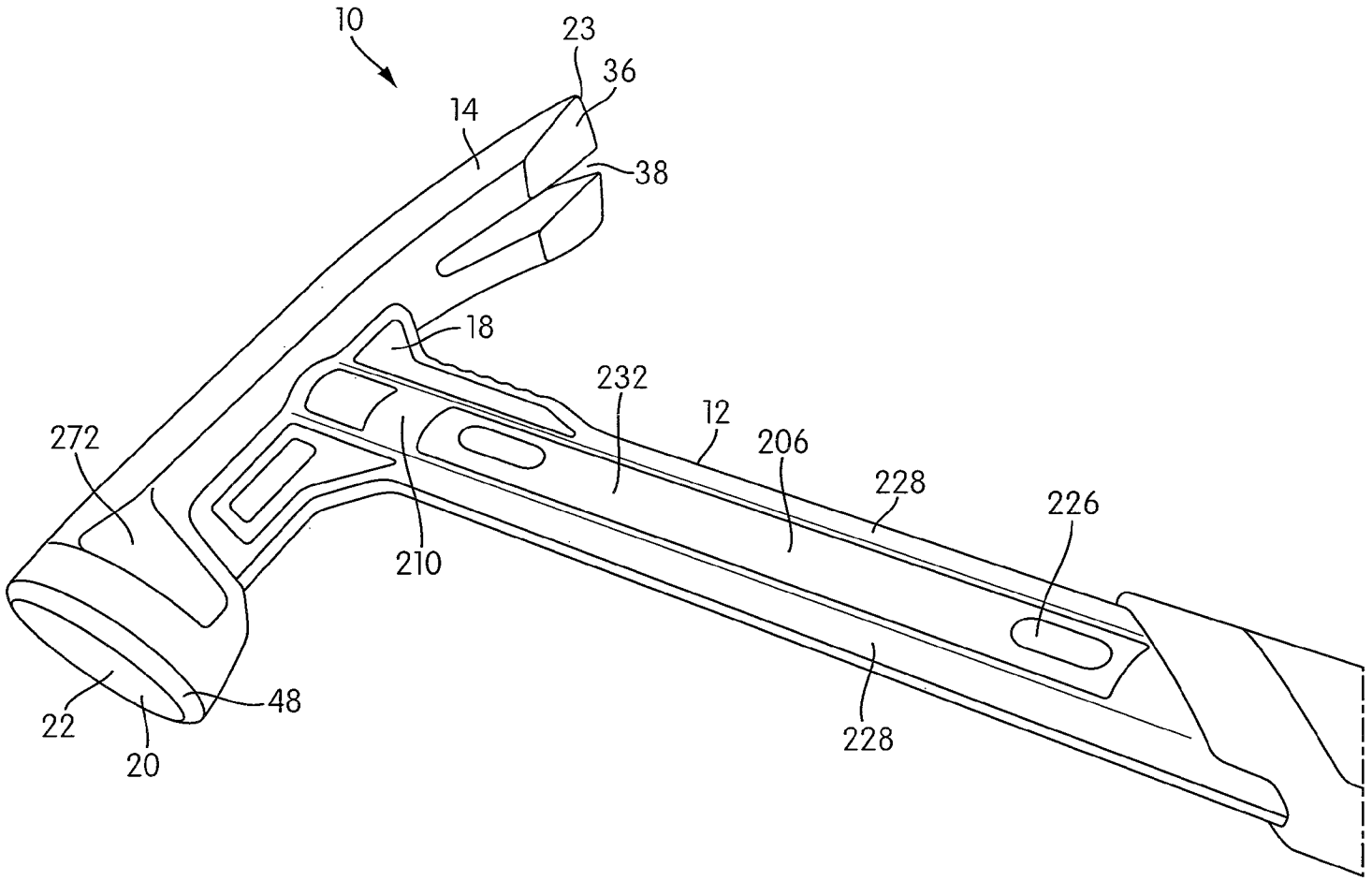
FIG. 17 shows a partial, perspective left hand side elevational view of the hammer in accordance with an embodiment of the present patent application.
Figure 18:
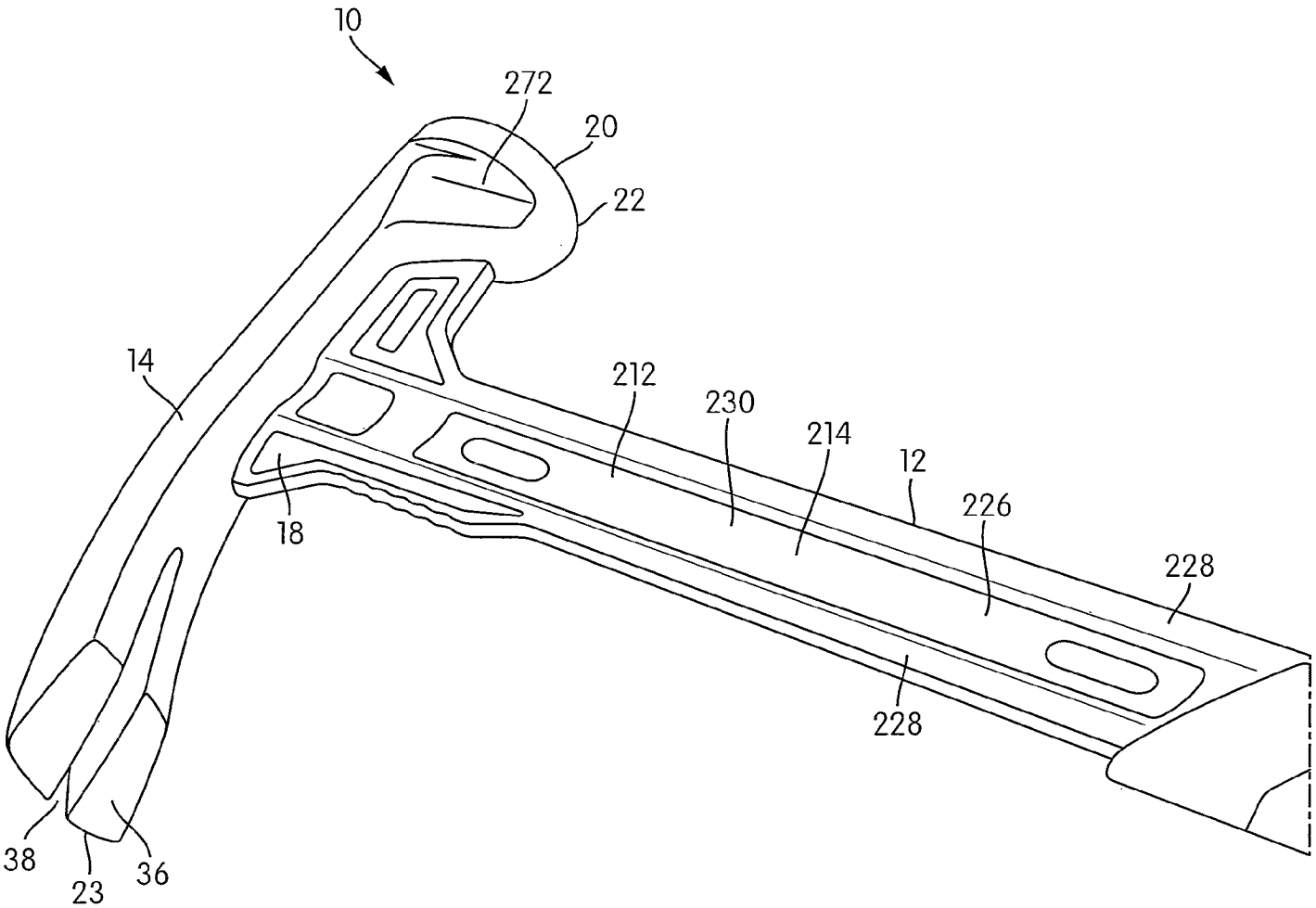
FIG. 18 shows a partial, perspective right hand side elevational view of the hammer in accordance with an embodiment of the present patent application.
Figure 19:
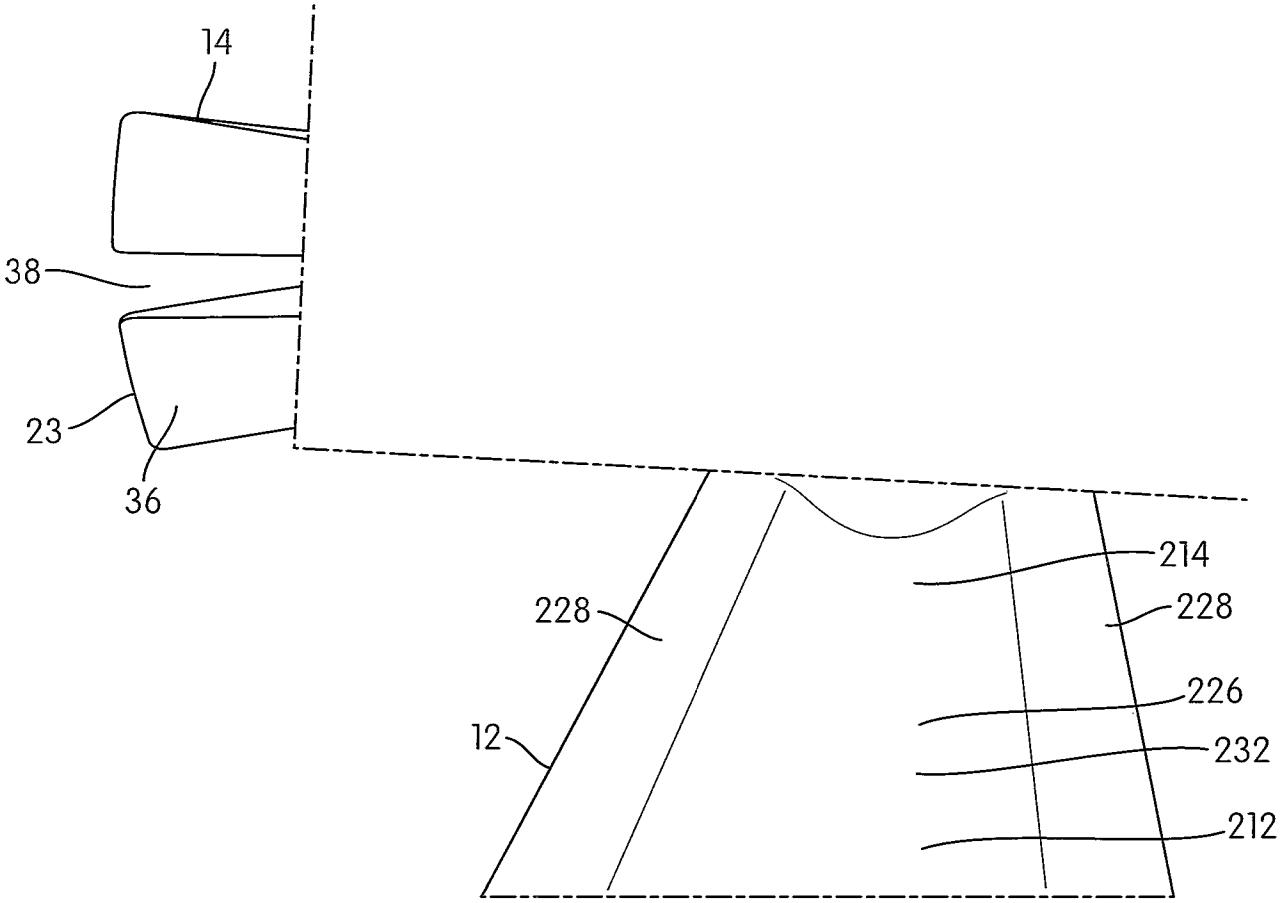
FIG. 19 shows another partial, perspective right hand side elevational view of the hammer in accordance with an embodiment of the present patent application, in which a planar member is placed on the hammer so as to clearly show the depth of a recess portion of the hammer.

In one embodiment, as shown and described in detail with respect to FIGS. 14, 17 and 18, at least a portion of the handle 12 has the protruding or rib portion 210 on one side 206 thereof and the recess portion 212 on the opposing side 214 thereof, where the protruding portion 210 is formed by displacing an amount of material corresponding to the recess portion 212 from one side 214 of the handle 12 to the other side 206 of the handle 12. That is, as shown in FIGS. 1, 2, 7, 8, 14 and 17, this protruding portion 210 is protrusive on the side 206 of the shaft 12 and recessive on the opposite side 214 of the shaft 12. In one embodiment, a convex surface 232 (as shown in FIG. 14) of the curved or concavo-convex shaped cross-sectional portion 226 of the handle 12 generally forms the protruding portion 210. Additionally, a concave surface 230 (as shown in FIG. 14) of the curved or concavo-convex shaped cross-sectional portion 226 of the handle 12 generally forms the recess portion 212. In one embodiment, as shown in FIGS. 1, 2, 7, 8 and 17, the protruding portion 210 (e.g., raised rib) and the recess portion 212 of the handle 12 extends through most of the length of the hammer handle 12. In one embodiment, the upper and lower ranges for the total percentage of the length of the hammer that is protruding or recessed are 100% and 5%, respectively. In this application, the terms "shaft" and "handle" may be used interchangeably, unless otherwise prescribed.

In one embodiment, as shown in FIGS. 8 and 14, at least a portion of the handle 12 has an overall handle width dimension HW measured in millimeters and a maximum handle thickness dimension HT measured in millimeters taken at the plane T-T that is perpendicular to the central longitudinal axis L-L of the hammer 10. In one embodiment, a ratio of the maximum handle thickness dimension HT to the overall handle width dimension HW is less than 0.75. In another embodiment, the ratio of the maximum handle thickness dimension HT to the overall handle width dimension HW is less than 0.4. In one embodiment, the ratio of the maximum handle thickness dimension HT to the overall handle width dimension HW is between 0.75 and 0.05. In another embodiment, the ratio of the maximum handle thickness dimension HT to the overall handle width dimension HW is between 0.6 and 0.1.

In one embodiment, the ratio of the maximum handle thickness dimension HT to the overall handle width dimension HW for the illustrated hammer of the present patent application having the maximum handle thickness dimension HT of 6.8 millimeters and the overall handle width dimension HW of 26.04 millimeters is 0.261. In one embodiment, the ratio of the maximum handle thickness dimension HT to the overall handle width dimension HW is 0.274, 0.248, 0.287, 0.235, 0.313, or 0.209.

In one embodiment, the ratio of the maximum handle thickness dimension HT to the overall handle width dimension HW for a framer hammer having the maximum handle thickness dimension HT of 7 millimeters and the overall handle width dimension HW of 26 millimeters is 0.269. In another embodiment, the ratio of the maximum handle thickness dimension HT to the overall handle width dimension HW for a nailer hammer having the maximum handle thickness dimension HT of 7 millimeters and the overall handle width dimension HW of 25 millimeters is 0.28.

In one embodiment, for a hammer having the maximum handle thickness dimension HT of 7 millimeters and the overall handle width dimension HW of 52 millimeters (i.e., the width of the handle is twice as large as the width of the handle of the nailer hammer), the ratio of the maximum handle thickness dimension HT to the overall handle width dimension HW drops to 0.135. In another embodiment, for a hammer having the maximum handle thickness dimension HT of 7 millimeters and the overall handle width dimension HW of 13 millimeters (i.e., the width of the handle is half as wide as the width of the handle of the nailer hammer), the ratio of the maximum handle thickness dimension HT to the overall handle width dimension HW increases to 0.538.

In one embodiment, for a hammer with no rib portion and having the overall handle width dimension HW of 26 millimeters, the ratio of the maximum handle thickness dimension HT to the overall handle width dimension HW is 0.183. Specifically, in this case, the maximum handle thickness dimension HT is 4.75 millimeters and the overall handle width dimension HW is 26 millimeters. In one embodiment, when a rib portion of a hammer has a thickness of 9.25 millimeters and the overall handle width dimension HW is 26 millimeters, the ratio of the maximum handle thickness dimension HT to the overall handle width dimension HW is 0.356.

In one embodiment, as noted above, the handle 12 includes recess portions or reduced thickness portions 212 on one side thereof and projection/rib portions or increased thickness portions 210 disposed thereon on the opposite side. In one embodiment, the maximum handle thickness dimension HT of the handle 12 is a thickness measurement measured at the section at portions of the handle 12 where the thickness of the handle is maximum. In one embodiment, the maximum handle thickness dimension HT is measured from the surface 206 of the longitudinal projection 210 on the one side of the handle 12 to the surface 208 of a portion of the second side on which the longitudinal recess 212 is not disposed. For example, in one embodiment, referring to FIG. 8, the maximum handle thickness dimension HT is measured in millimeters from the left-most side surface 208 of the handle 12 to the right-most side surface 206, taken along the transverse plane T-T as shown.

In one embodiment, as shown in FIG. 14, the longitudinal projection 210 has a projection width dimension PW measured in millimeters taken at the plane T-T that is perpendicular to the central longitudinal axis L-L of the hammer 10 and the handle has the overall handle width dimension HW measured in millimeters taken at the plane T-T that is perpendicular to the central longitudinal axis L-L of the hammer 10. In one embodiment, a ratio of the projection width dimension PW to the overall handle width dimension HW is less than 0.7. In one embodiment, a ratio of the projection width dimension PW to the overall handle width dimension HW is less than 0.95. In one embodiment, the ratio of the projection width dimension PW to the overall handle width dimension HW is between 0.95 and 0.05. In another embodiment, the ratio of the projection width dimension PW to the overall handle width dimension HW is between 0.6 and 0.7.

In one embodiment, the ratio of the projection width dimension PW to the overall handle width dimension HW of a nailer hammer having a projection width dimension PW of 16.78 millimeters and an overall width dimension HW of 25 millimeters is 0.67. In another embodiment, the ratio of the projection width dimension PW to the overall handle width dimension HW of a framer hammer having a projection width dimension PW of 17 millimeters and an overall width dimension HW of 26 millimeters is 0.65.

In one embodiment, the ratio of the projection width dimension PW to the overall handle width dimension HW for the illustrated hammer having the maximum handle thickness dimension HT of 16.18 millimeters and the overall handle width dimension HW of 26.04 millimeters is 0.621. In one embodiment, the ratio of the projection width dimension PW to the overall handle width dimension HW is 0.652, 0.59, 0.683, 0.559, 0.745, or 0.497.

In one embodiment, the projection may be almost as wide as the shaft of the hammer. In such an embodiment, the ratio of the projection width dimension PW to the overall handle width dimension HW approaches 1. In another embodiment, the projection width may shrink down to one time the material thickness or 4.75 millimeters. In such an embodiment, the ratio of the projection width dimension PW of 4.75 millimeters to the overall handle width dimension HW of 26 millimeters is 0.18.

In another embodiment, as shown in FIG. 14, the longitudinal recess 212 has a recess width dimension RW measured in millimeters taken at the plane T-T that is perpendicular to the central longitudinal axis of the hammer 10 and the handle 12 has an overall handle width dimension HW measured in millimeters taken at the plane T-T that is perpendicular to the central longitudinal axis L-L of the hammer 10. In one embodiment, a ratio of the recess width dimension RW to the overall handle width dimension HW is less than 0.95. In one embodiment, the ratio of the recess width dimension RW to the overall handle width dimension HW is between 0.95 and 0.05.

In one embodiment, the ratio of the recess width dimension RW to the overall handle width dimension HW of a framer hammer having a recess width dimension RW of 14.95 millimeters and an overall width dimension HW of 26 millimeters is 0.575. In another embodiment, the ratio of the recess width dimension RW to the overall handle width dimension HW of a nailer hammer having a recess width dimension RW of 15.48 millimeters and an overall width dimension HW of 25 millimeters is 0.62.

In one embodiment, the ratio of the recess width dimension RW to the overall handle width dimension HW for the illustrated hammer having the recess width dimension RW of 15.215 millimeters and the overall handle width dimension HW of 26.04 millimeters is 0.584. In one embodiment, the ratio of the projection width dimension PW to the overall handle width dimension HW is 0.613, 0.555, 0.643, 0.526, 0.701, or 0.467.

In one embodiment, the recess may be almost as wide as the width of the shaft. In such an embodiment, the ratio of the recess width dimension RW to the overall handle width dimension HW approaches 1. In another embodiment, the hammer may not include a recess portion. In such an embodiment, the ratio of the recess width dimension RW to the overall handle width dimension HW approaches 0.

In one embodiment, the projection width dimension PW is a width dimension measured from one end of projection 210 to the other, opposite end of the projection 210. In one embodiment, the recess width dimension RW is a width dimension measured from one end of recess 212 to the other, opposite end of the recess 212. In one embodiment, the projection width dimension PW is same as the recess width dimension RW.

In one embodiment, as shown in FIG. 14, the longitudinal projection 210 has a projection height dimension PH measured in millimeters taken at taken at the plane T-T that is perpendicular to the central longitudinal axis L-L of the hammer 10. In one embodiment, the longitudinal recess 212 has a recess depth dimension RD measured in millimeters taken at the plane T-T that is perpendicular to the central longitudinal axis L-L of the hammer 10. In one embodiment, as shown in FIG. 14, the projection height dimension PH is measured from the swing plane SP-SP of the hammer 10 to the surface 206 of the longitudinal projection 210 on the one side of the handle 12. In one embodiment, a ratio of the projection height dimension PH to the recess depth dimension RD is less than 1.05. In another embodiment, the ratio of the projection height dimension PH to the recess depth dimension RD is less than 3. In one embodiment, the ratio of the projection height dimension PH to the recess depth dimension RD is between 3 and 0.5. In another embodiment, the ratio of the projection height dimension PH to the recess depth dimension RD is between 1.2 and 0.8.

In one embodiment, the ratio of the projection height dimension PH to recess depth dimension RD for the illustrated hammer having the projection height dimension PH of 4.56 millimeters and the recess depth dimension RD of 2.24 millimeters is 2.036. In one embodiment, the ratio of the projection height dimension PH to the recess depth dimension RD is 2.138, 1.934, 2.4, 1.832, 2.443, or 1.629.

In one embodiment, the ratio of the height of the projection to the depth of the recess is approximately 1, i.e., the height of the projection is approximately equal to the depth of the recess, for example, when the hammer is made by stamping a sheet metal material. If the ratio is measured inside the coining details (i.e., decorative pockets) of the shaft, then the ratio of the height of the projection to depth of the recess may decrease to roughly 0.84.

In one embodiment, the height of the projection is greater than the depth of the recess. In another embodiment, the height of the projection is less than the depth of the recess. In one embodiment, when the height of the projection is greater/less than the depth of the recess, the hammer may be formed using a forged part. In such an embodiment, the ratio of the height of the projection to the depth of the recess is greater than 1. In one embodiment, if the height of the projection is three times the depth of the recess, the ratio of the height of the projection to the depth of the recess is approximately 3. In another embodiment, if the recess is two times as deep as the height of the projection, the ratio of the height of the projection to the depth of the recess is approximately 0.5.

Figure 3:
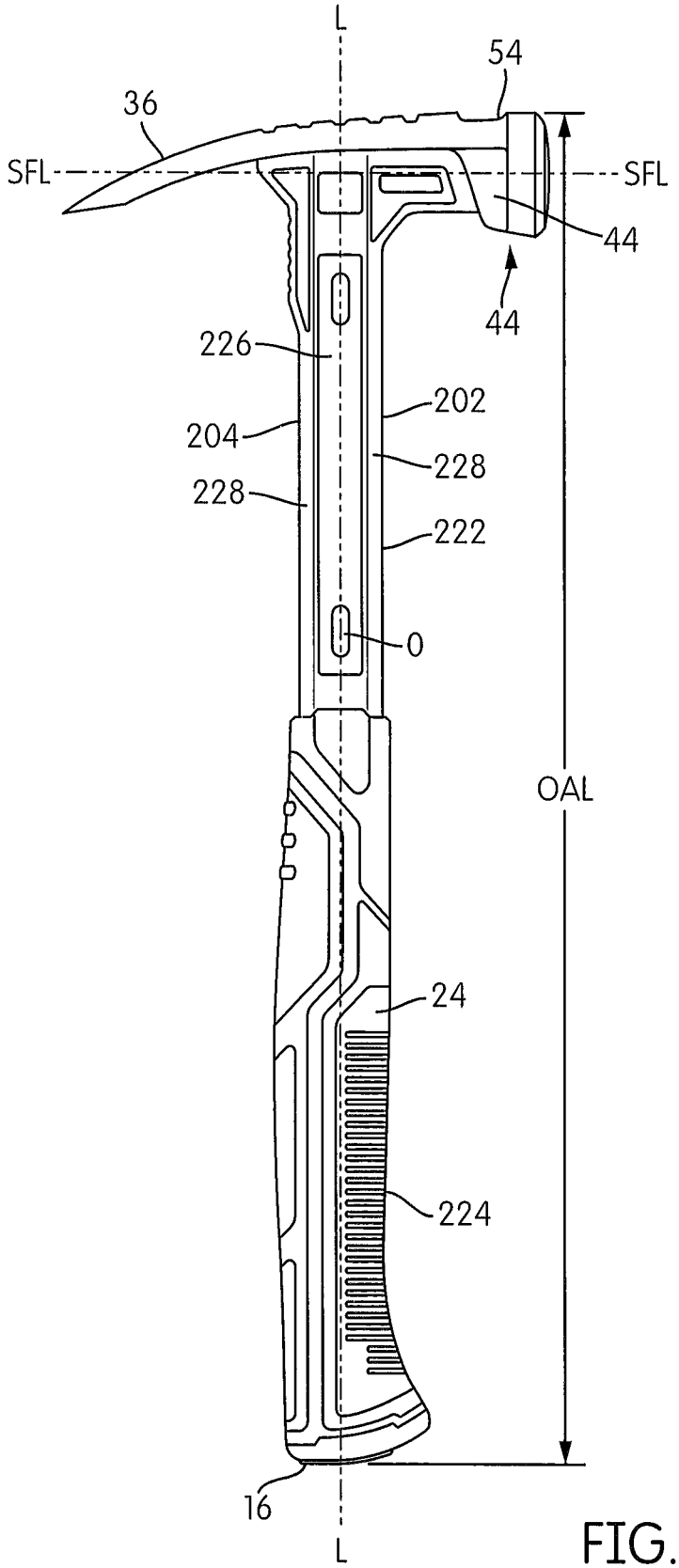
FIGS. 3 and 4 show right hand side elevational views of the hammer in accordance with an embodiment of the present patent application, where the hammer gripping portion of the hammer is not shown in FIG. 4 for sake of clarity.

The hammer 10 includes an overall length dimension OAL (as shown in FIG. 3). In one embodiment, as shown in FIGS. 3, 4, 7 and 8, the overall length dimension OAL of the hammer 10 is measured along (or relative to) the central longitudinal axis L-L of the hammer 10. The overall length dimension OAL is measured from the bottom-most end surface 16 of the handle 12 to a top most end 54 of the head 14, taken along central longitudinal axis L-L as shown.

In non-limiting examples, the weight of the hammer 10 is nominally between 10 and 50 ounces; and the overall length dimension OAL of the hammer 10 is between 12 and 18 inches.

In one embodiment, the weight of the head of the hammer, measured at a plane perpendicular to the swing plane and parallel to the central axis of the bell portion that is 2 inches from the top of the head of the hammer, is between 10 and 30 ounces.

As shown in FIGS. 1 and 2, the head 14 of the hammer 10 includes the striking surface 20 at one end 22 thereof, and a pair of tapered, spaced-apart nail removing claws 36 at the opposing end 23. In one embodiment, the nail removing claws 36 of the head 14 of the hammer 10 are spaced apart so as to provide a V-shaped space 38 (as shown in FIGS. 5, 6, 11, 12, 17 and 18) therebetween. The shank of a nail can be received in the V-shaped space 38 with the top of the hammer 10 facing the work piece and the nail is removed by engaging the spaced apart claws 36 with the head of the nail and withdrawing the nail from a work piece. In some embodiments, no claw is provided (e.g., a ball peen hammer). In one embodiment, the head 14 of the hammer 10 is made of steel, iron, titanium, or other suitable metal material.

In one embodiment, a bell portion 44 located at the forward portion of the head. 14 of the hammer 10 includes the striking surface 20. A chamfer or bevel 48 is located circumferentially along the edges of the striking surface 20 of the hammer 10. In one embodiment, as shown in FIGS. 11 and 12, the striking surface 20 of the hammer 10 is slightly convex in order to facilitate square contact during driving of nails.

As noted above, the head 14 of the hammer 10 is disposed at the upper portion 18 of the handle 12. In one embodiment, the head 14 of the hammer 10 is integrally formed with the upper portion 18 of the handle 12. In this embodiment, the handle has a metal (e.g., steel or titanium) shaft integrally formed with the head of the same material. In one embodiment, a covering of different material (e.g., an elastomer material) may be provided on top of the metal shaft. In another embodiment, the head and the handle are formed separately and then connected to one another. For example, the head 14 of the hammer 10 may be mounted on the upper portion 18 of the handle 12 by securing the upper portion 18 of the handle 12 into a portion (e.g., an eye portion) of the head 14 of the hammer 10. Any suitable manner of connecting the head 14 and handle 12 may be employed. In this embodiment, the handle shaft 12 can be made from a different material than the head 14.

In one embodiment, as shown in FIGS. 17 and 18, one or more recesses 272 are located adjacent to but spaced from the striking surface 20 of the head 14. In one embodiment, a relatively large striking surface 20 is provided without substantially increasing the overall weight of the overall hammer 10 or of the head 14 by providing these recesses 272. The handle 12 can be formed by stamping, forging, or other known process.

Figure 11:
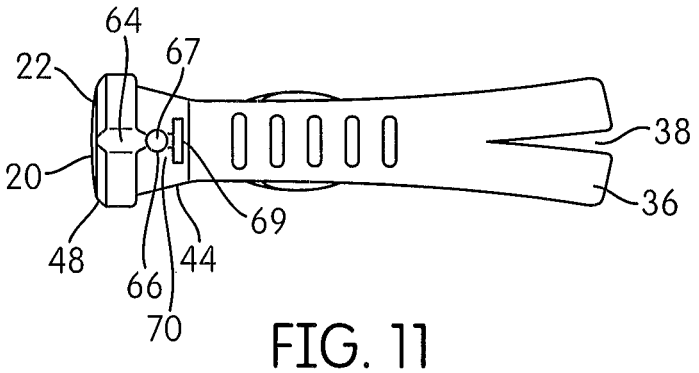
FIGS. 11 and 12 show top plan views of the hammer in accordance with an embodiment of the present patent application, where the hammer grip portion of the hammer is not shown in FIG. 12 for sake of clarity.
Figure 12:
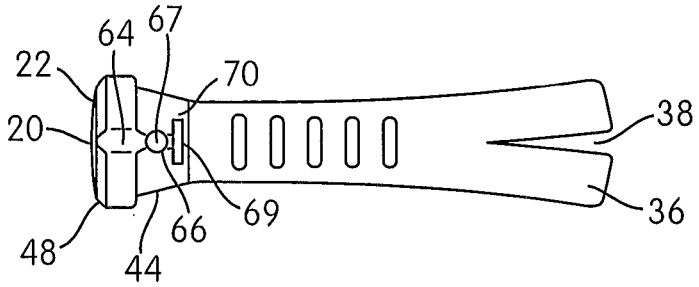
Figure 13:
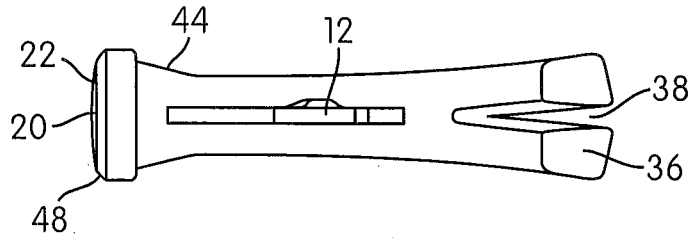
FIG. 13 shows a bottom plan view of the hammer in accordance with an embodiment of the present patent application, where the hammer gripping portion of the hammer is not shown for sake of clarity.

As shown in FIGS. 11 and 12, a groove 64 is located along a top surface of the bell 44. The groove 64 is constructed and arranged to receive and retain a nail (not shown) therein, when the nail is placed in an initial nail driving position to facilitate the start of a nail driving operation. In one embodiment, an opening or groove 66 may be disposed on the bell portion 44 and is configured to receive a magnet 67 therein. The magnet 67 is constructed and arranged to help retain the nail in the initial nail driving position in the groove 64 to facilitate the start of the nail driving operation. A notch 70 is disposed on the top surface of the bell portion 44 and a surface 69 of the hammer 10 is constructed and arranged to support a head of the nail. Thus, the groove 64, the magnet 67, and the surface 69 act together to position and to initially drive the nail in a first blow into a work piece. The nail starter arrangement that includes the groove 64, the magnet 67, and the surface 69 are optional.

In one embodiment, the handle 12 is made of metal, a composite material, or a synthetic material. In another embodiment, the handle 12 of the hammer 10 is made of a lighter material, such as wood, aluminum, a plastic material, a fiberglass material, or other suitable material.

Figure 4:
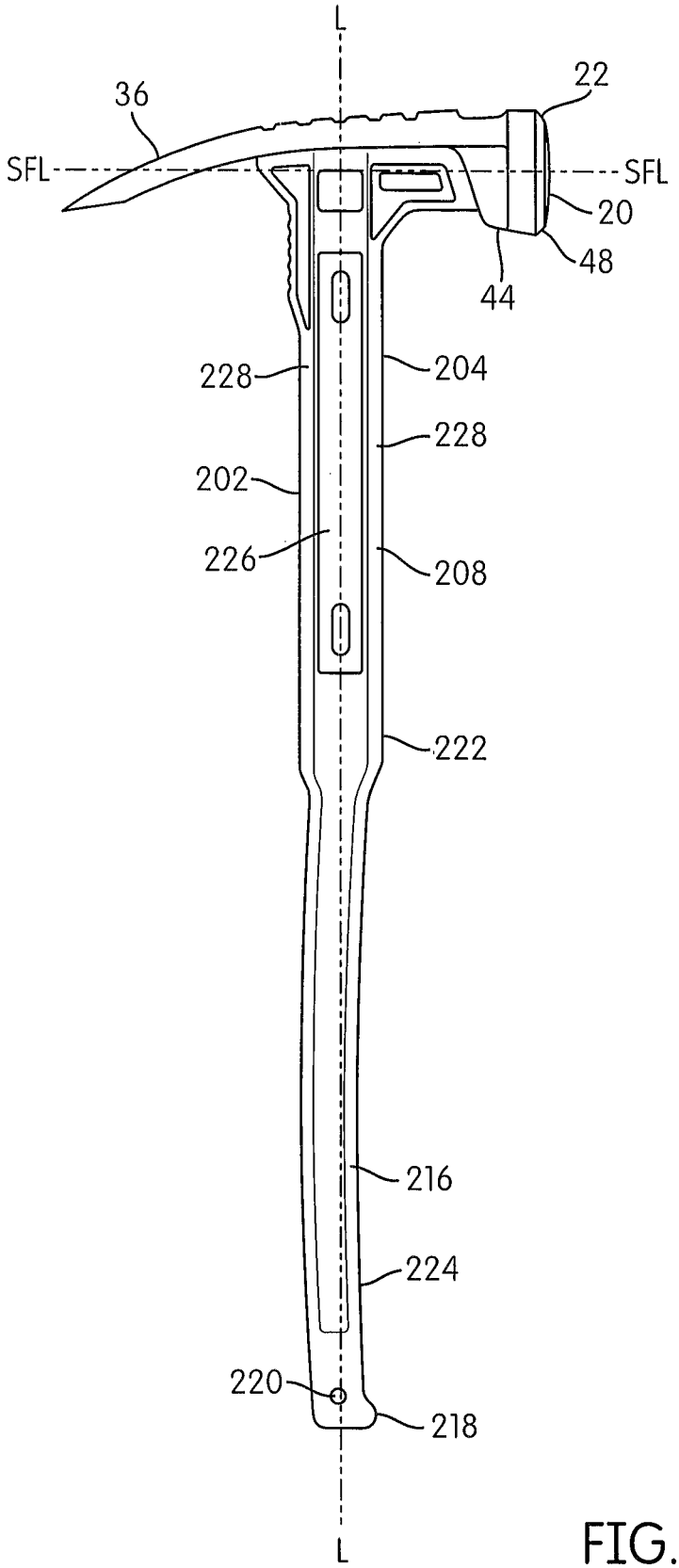
Figure 5:
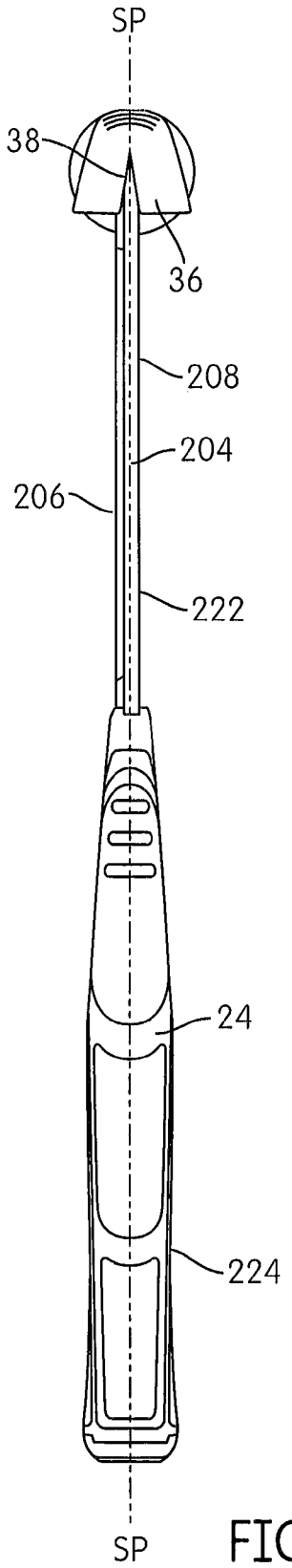
FIGS. 5 and 6 show rear elevational views of the hammer in accordance with an embodiment of the present patent application, where the hammer gripping portion of the hammer is not shown in FIG. 6 for sake of clarity.

In one embodiment, as shown in FIGS. 3, 4, 7 and 8, the handle 12 includes an upper handle portion 222 and a lower handle portion 224. In one embodiment, as shown in FIG. 1, the lower handle portion 224 is configured to receive a manually engageable gripping portion 24 thereon. In one embodiment, the gripping portion 24 is simply the outer surface of the handle material (e.g., wood or metal). In another embodiment, gripping portion 24 of the hammer 10 is molded onto an inner or core portion 216 (as shown in FIG. 4) of the handle 12. In one embodiment, the gripping portion 24 of the handle 12 is made of an elastomeric material, a rubber based material, a plastic based material or other suitable material. Optionally, the gripping portion 24 can be ergonomically shaped.

In one embodiment, referring to FIG. 4, a core member 216 of the handle 12 has protrusions and or other similar structures to provide a mechanical interface for the overmolded material (i.e., material of the gripping portion 24). For example, as shown in FIG. 4, protrusion 218 and through hole 220 are provided on the core member 216 that enable a mechanical bond to be formed between the core member 216 and the material of the gripping portion 24 that is overmolded thereon. The protrusion 218 and through hole 220 provide interlocks for the material of the gripping portion 24 to take hold of the core member 216. For example, the through holes 220 allow the material of the gripping portion 24 to flow/pass therethrough.

Figure 16:
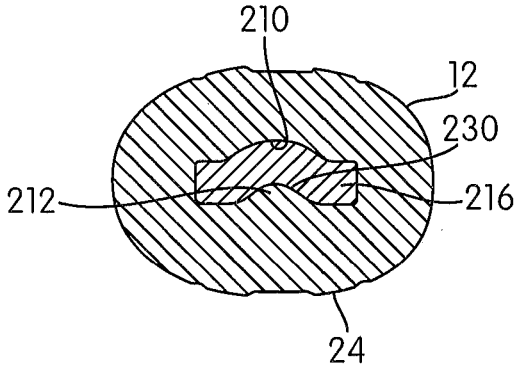
FIG. 16 shows a sectional view of the hammer taken along the line 16-16 of FIG. 7 in accordance with an embodiment of the present patent application.

As shown in FIG. 16, the material of the gripping portion 24 is configured to conform to the concavo-convex cross-sectional shaped configuration of the core member 216 of the handle 12. That is, the material of the gripping portion 24 is configured to flow into the recess portion 212 (i.e., portion adjacent concave surface 230) and to surround the protruding portion 210. In one embodiment, the recessed portion 212 and the protruding portion 210 of the core member 216 enable a mechanical bond to be formed between the core member 216 of the handle 12 and the gripping portion 24.

In one embodiment, as the shaft or handle of the hammer of the present patent application is made of a steel material, the hammer is inherently resilient to an overstrike.

The swing plane of the hammer, as referred in the present patent application, is a plane, which, as viewed in FIGS. 5, 6, 9 and 10, is perpendicular to the page and extends longitudinally through the center of the hammer 10. The swing plane SP-SP of the hammer is shown in FIGS. 5, 6, 9, 10, 14 and 15. When the hammer is swung in its swing plane SP-SP, the striking surface 20 strikes an object, such as a nail or a chisel.

The swing plane SP-SP of the hammer 10 is generally perpendicular to a plane that passes through the central longitudinal axis L-L (as shown in FIGS. 3, 4, 7 and 8) of the hammer 10. The swing plane SP-SP of the hammer 10 is also generally.perpendicular to the transverse planes T-T and $T_1$-$T_1$ (as shown in FIG. 8) of the hammer 10. The plane that passes through the central longitudinal axis L-L (as shown in FIGS. 3, 4, 7 and 8) of the hammer 10 is also generally perpendicular to the transverse planes T-T and $T_1$-$T_1$ (as shown in FIG. 8) of the hammer 10. That is, the transverse planes T-T and $T_1$-$T_1$ (as shown in FIG. 8), the plane that passes through the central longitudinal axis L-L (as shown in FIGS. 3, 4, 7 and 8), and the swing plane SP-SP of the hammer 10 are perpendicular to each other. As shown in FIG. 8, the transverse plane $T_1$-$T_1$ is parallel and spaced-apart from the transverse plane T-T and both the transverse planes $T_1$-$T_1$ and T-T are perpendicular to the central longitudinal axis L-L of the hammer 10.

As noted above, the hammer 10 includes the overall handle width dimension HW. In one embodiment, as shown in FIGS. 8 and 14, the overall handle width dimension HW of the hammer 10 is measured at the transverse plane T-T that is perpendicular to the central longitudinal axis L-L of the hammer 10. Referring to FIG. 8, the overall handle width dimension HW is measured in millimeters from a front surface 202 to a rear surface 204 of the handle 12, taken along the transverse plane T-T as shown.

Figure 6:
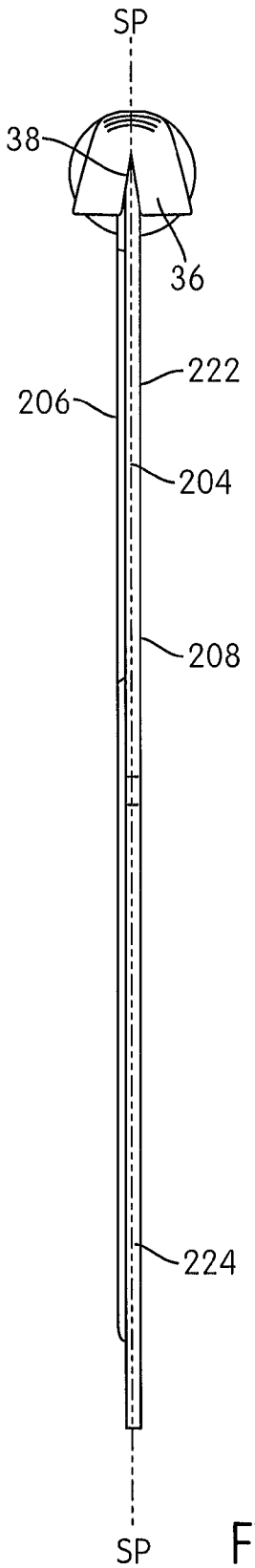
Figure 7:
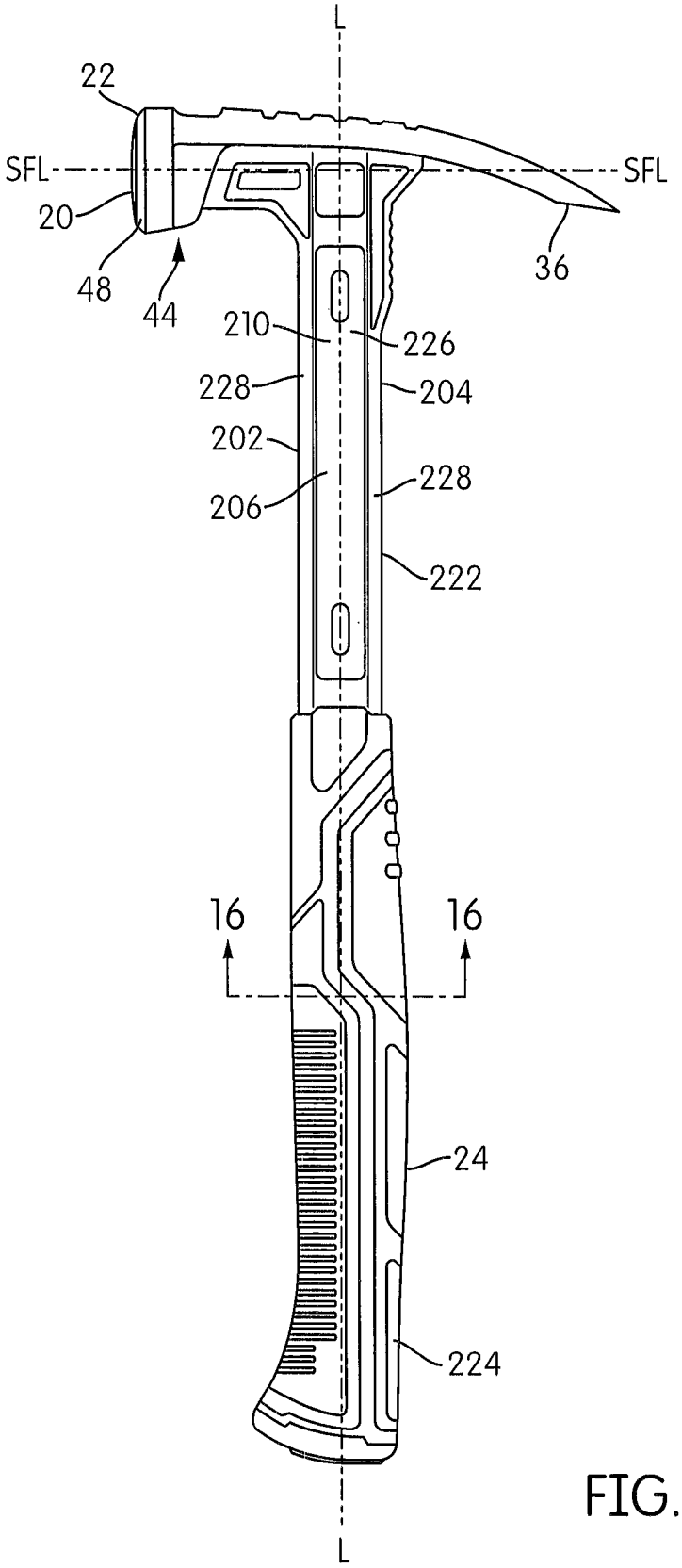
FIGS. 7 and 8 show left hand side elevational views of the hammer in accordance with an embodiment of the present patent application, where the hammer gripping portion of the hammer is not shown in FIG. 8 for sake of clarity.

As noted above, the hammer 10 includes the maximum handle thickness (depth or height) dimension HT. In one embodiment, as shown in FIG. 14, the maximum handle thickness dimension HT of the hammer 10 is measured at the transverse plane T-T of the hammer 10. Referring to FIG. 6, the maximum handle thickness dimension HT is measured in millimeters from the left-most side surface 208 of the handle 12 to the right-most side surface 206, taken along the transverse plane T-T as shown.

In non-limiting examples, the overall handle width HW of the hammer 10 is between 24.5 and 26.5 millimeters; and the maximum handle thickness HT of the hammer 10 is between 6.5 and 7.5 millimeters.

In one embodiment, the lateral stiffness of the shaft 12 in this present patent application is a function of the cross-sectional shape of the shaft 12 and the height of the protruding portion 210 of the shaft 12.

In general, the higher the height of the protruding portion 210 (or the wider the shaft 12), the stiffer the hammer 10 will be. Therefore, the ratio of the maximum shaft height dimension HT (measured in millimeters) to the overall shaft width dimension HW (measured in millimeters) is an important feature of this present patent application. In one embodiment, the ratio of the maximum handle thickness dimension HT to the overall handle width dimension HW is less than 0.75. In another embodiment, the ratio of the maximum handle thickness dimension HT to the overall handle width dimension HW is less than 0.4. In one embodiment, the ratio is between 0.75 and 0.05. In another embodiment, the ratio is between 0.6 and 0.1.

Figure 15:
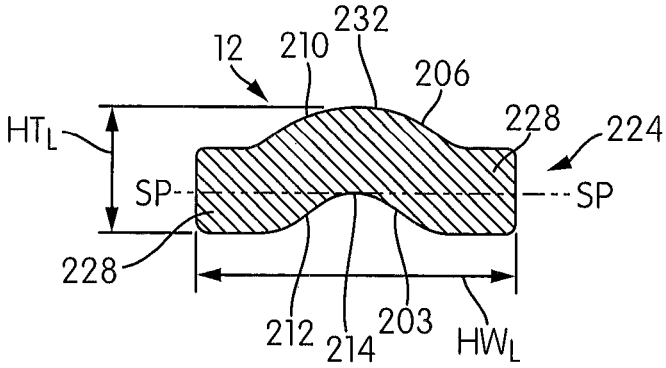
FIG. 15 shows a sectional view of the hammer taken along the line 15-15 of FIG. 8 in accordance with an embodiment of the present patent application.

The cross-sectional configuration of the core member 216 of the handle 12 taken at the transverse plane T-T (i.e., perpendicular to the central longitudinal axis L-L of the hammer 10) is shown in FIG. 14 and the cross-sectional configuration of the core member 216 of the handle 12 taken at the transverse plane $T_1$-$T_1$ (i.e., perpendicular to the central longitudinal axis L-L of the hammer 10) is shown in FIG. 15.

Referring to FIG. 14, the cross-sectional configuration of the core member 216 of the handle 12 generally has the concavo-convex shaped cross-sectional configuration portion 226. In one embodiment, the concavo-convex shaped cross-sectional configuration portion 226 includes the convex surface 232 forming the protruding portion 210 on one side 206 of the hammer 10 and the concave surface 230 forming the recess portion 212 on the opposing side 214 of the hammer 10. In one embodiment, the hammer 10 includes the end portions 228 disposed at ends of the concavo-convex shaped cross-sectional configuration portion 226. In one embodiment, the end portions 228 generally have rectangular cross-sectional configuration. In one embodiment, the convex surface 232 of the concavo-convex shaped cross-sectional configuration portion 226 projects beyond the portion of rectangular cross-sectional configuration of the end portions 228 by an amount corresponding to the depth of the recess portion 212.

In one embodiment, as shown in FIGS. 14 and 15, the concavo-convex shaped cross-sectional configuration portion 226 is asymmetrical about the swing plane SP-SP of the hammer 10. This asymmetrical concavo-convex shaped cross-sectional configuration portion 226 of the handle 10 is adapted to increase the lateral stiffness of the handle. The lack of symmetry in the concavo-convex shaped cross-sectional configuration portion 226 (i.e., about the swing plane SP-SP of the hammer 10) is seen clearly in FIGS. 14 and 15. Specifically, referring to FIGS. 14 and 15, the concavo-convex shaped cross-sectional configuration portion 226 is offset with respect to the swing plane SP-SP of the hammer 10. That is, the upper portion of the concavo-convex shaped cross-sectional configuration portion 226 is offset to one side of the swing plane SP-SP of the hammer 10.

In one embodiment, as shown in FIGS. 14 and 15, the lower handle portion 224 has an overall handle width dimension $HW_L$ and the upper handle portion 222 has an overall handle width dimension $HW_U$. In one embodiment, as shown in FIGS. 8, 14 and 15, the overall handle width dimension $HW_L$ of the lower handle portion 224 and the overall handle width dimension $HW_U$ of the upper handle portion 222 are measured at the transverse planes $T_1$-$T_1$ and T-T, respectively, of the hammer 10.

In one embodiment, as shown in FIGS. 14 and 15, the overall handle width dimension $HW_L$ of the lower handle portion 224 is different from the overall handle width dimension $HW_U$ of the upper handle portion 222. In one embodiment, as shown in FIGS. 14 and 15, the overall handle width dimension $HW_L$ of the lower handle portion 224 is smaller than the overall handle width dimension $HW_U$ of the upper handle portion 222 so as to maintain a light weight configuration of the hammer while providing the desired lateral stiffness to the handle 12. In one embodiment, the overall handle width dimension $HW_U$ of the upper handle portion 222 is higher than the overall handle width dimension $HW_L$ of the lower handle portion 224 so as to provide the desired lateral stiffness to the handle 12. That is, as the increased width is most useful in the upper portion 222 of the handle 12, the width of the hammer shaft in the upper portion 222 $HW_U$ is increased relative to the width $HW_L$ of the lower portion 224 in order to provide the desired lateral stiffness to the handle 12. In another embodiment, the overall handle width dimension $HW_L$ of the lower handle portion 224 may be same as the overall handle width dimension $HW_U$ of the upper handle portion 222. In yet another embodiment, the overall handle width dimension $HW_L$ of the lower handle portion 224 may be greater than the overall handle width dimension $HW_U$ of the upper handle portion 222. The overall handle width dimension $HW_L$ of the lower handle portion may be greater than the overall handle width dimension $HW_U$ of the upper handle portion, for example, in a 10 ounces welded hammer. In one embodiment, the lower handle portion 224 has a maximum handle thickness dimension $HT_L$ and the upper handle portion 222 has a maximum handle thickness dimension $HT_U$. In one embodiment, as shown in FIGS. 8, 14 and 15, the maximum handle thickness dimension $HT_L$ of the lower handle portion 224 and the maximum handle thickness dimension $HT_U$ of the upper handle portion 222 are measured at the transverse planes $T_1$-$T_1$ and T-T, respectively, of the hammer 10.

In one embodiment, as shown in FIGS. 14 and 15, the maximum handle thickness dimension $HT_L$ of the lower handle portion 224 is same as the maximum handle thickness dimension $HT_U$ of the upper handle portion 222. In another embodiment, the maximum handle thickness dimension $HT_L$ of the lower handle portion 224 may be different from the maximum handle thickness dimension $HT_U$ of the upper handle portion 222. In one embodiment, the maximum upper handle portion thickness dimension $HT_U$ is greater than the maximum lower handle portion thickness dimension $HT_L$.

As shown in FIG. 15, the cross-sectional configuration of the core member 216 of the handle 12 taken at the transverse plane $T_1$-$T_1$ is very similar to that of the cross-sectional configuration of the core member 216 of the handle 12 taken at the transverse plane T-T, except for the noted difference. As noted above, the overall handle width dimension $HW_L$ of the lower handle portion 224 is smaller as the overall handle width dimension $HW_U$ of the upper handle portion 222, therefore, the cross-sectional configuration of the core member 216 of the handle 12 taken at the transverse plane $T_1$-$T_1$ is generally narrower than that of the cross-sectional configuration of the core member 216 of the handle 12 taken at the transverse plane T-T.

FIGS. 14 and 15 show portions and dimensions of the handle core portion of the hammer 10 in accordance with an embodiment of the present patent application. The portions and dimensions of the handle core portion of the hammer 10 shown in FIGS. 14 and 15 are intended to be merely exemplary and not limiting in any way. The portions and dimensions of the handle core portion of the hammer 10 shown in FIGS. 14 and 15 are drawn to scale in accordance with one embodiment, although other scales and shapes may be used in other embodiments. The dimensions of the handle core portion as shown in FIGS. 14 and 15 are measured in millimeters unless indicated otherwise. In one embodiment, the dimensions of the handle core portion of the hammer 10, as shown in FIGS. 14 and 15 and as described in the present patent application, are up to 10 percent greater than or up to 10 percent less than those illustrated. In another embodiment, the dimensions of various parts of the hammer 10, as shown in FIGS. 14 and 15 and as described in the present patent application, are up to 5 percent greater than or up to 5 percent less than those illustrated. In yet another embodiment, the dimensions of various parts of the hammer 10, as shown in FIGS. 14 and 15 and as described in the present patent application, are up to 20 percent greater than or up to 20 percent less than those illustrated.

In one embodiment, for dimensions having one digit after the decimal place, the tolerance is ±0.25 millimeters. In one embodiment, for dimensions having two digits after the decimal place, the tolerance is ±0.1 millimeters.

In one embodiment, the handle described in the present patent application may be used, for example, in the hammer disclosed in U.S. patent Ser. No. 13/605,151, which is hereby incorporated by reference in its entirety.

The hammer shaft or handle of the present patent application is constructed and arranged to provide a high lateral stiffness (or strength) while maintaining a light weight configuration. As discussed above, in one embodiment, the present patent application achieves this very high lateral stiffness (i.e., while keeping the shaft or handle weight low), for example, by making the cross sectional shape along the swing plane asymmetrical.

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

What is claimed is:

1. A hammer comprising:

a handle, the handle having a bottom end and an upper portion, the handle having a longitudinal axis extending in a swing plane of the hammer; and a head disposed on the upper portion of the handle, the head having a strike face, and the strike face having a longitudinal axis extending in the swing plane of the hammer, wherein a majority of the longitudinal length of the handle has a longitudinal projection on a first side of the handle and a longitudinal recess on a second side of the handle opposite the first side, and wherein the first side of the handle and the second side of the handle generally face opposite directions that are perpendicular to the swing plane.

2. The hammer of claim 1, wherein the longitudinal projection and longitudinal recess comprise a concavo-convex shaped longitudinal configuration.

3. The hammer of claim 1, further comprising longitudinal flat end portions having opposite parallel sides, the longitudinal flat end portions are disposed on opposite sides of the longitudinal projection and the longitudinal recess.

4. The hammer of claim 1, wherein the longitudinal projection is disposed on one side of the swing plane and the longitudinal recess is disposed on opposite side of the swing plane.

5. The hammer of claim 1, wherein the longitudinal projection has a projection width dimension measured in millimeters taken at an axis perpendicular to the longitudinal axis of the handle and the handle has an overall handle width dimension measured in millimeters taken at the axis perpendicular to the longitudinal axis of the handle, and wherein a ratio of the projection width dimension to the overall handle width dimension is less than 0.7.

6. The hammer of claim 5, wherein the ratio of the projection width dimension to the overall handle width dimension is between 0.6 and 0.7.

7. The hammer of claim 1, wherein the longitudinal projection has a projection height dimension measured in millimeters taken at an axis perpendicular to the longitudinal axis of the handle and the longitudinal recess has a recess depth dimension measured in millimeters taken at the axis perpendicular to the longitudinal axis of the handle, wherein the projection height dimension is measured from the swing plane of the hammer to a surface of the projection, and wherein a ratio of the projection height dimension to the recess depth dimension is less than 1.05.

8. The hammer of claim 7, wherein the ratio of the projection height dimension to the recess depth dimension is between 1.2 and 0.8.

9. The hammer of claim 1, wherein the handle has a maximum handle thickness dimension measured in millimeters and an overall handle width dimension measured in millimeters taken at an axis perpendicular to the longitudinal axis of the handle, and wherein a ratio of the maximum handle thickness dimension to the overall handle width dimension is less than 0.4.

10. The hammer of claim 9, wherein the ratio of the maximum handle thickness dimension to the handle width dimension is between 0.6 and 0.1.

11. The hammer of claim 1, wherein the handle includes an upper handle portion having a maximum upper handle portion thickness dimension and a lower handle portion having a maximum lower handle portion thickness dimension.

12. The hammer of claim 11, wherein the maximum upper handle portion thickness dimension is greater than the maximum lower handle portion thickness dimension.

13. A method of forming a hammer, the hammer having a handle with a bottom end, an upper portion and a longitudinal axis extending in a swing plane of the hammer, and a head disposed on the upper portion of the handle, the head having a strike face, and the strike face having a longitudinal axis extending in the swing plane of the hammer, the method comprising:

forming a longitudinal projection on a first side of the handle and a longitudinal recess on a second side of the handle opposite the first side by displacing an amount of material corresponding to the longitudinal recess from the second side of the handle to the first side of the handle, wherein the longitudinal projection and longitudinal recess are formed for a majority of the longitudinal length of the handle.

14. A hammer comprising:

a handle, the handle having a bottom end, an upper portion, and a first side and a second side that generally face opposite directions that are perpendicular to a swing plane of the hammer; and a head disposed on the upper portion of the handle, wherein the first side includes a longitudinal projection on at least a portion thereon and the second side includes a longitudinal recess on at least a portion thereon, and wherein at least a portion of the handle has a maximum handle thickness dimension measured in millimeters and an overall handle width dimension measured in millimeters taken at an axis perpendicular to a central longitudinal axis of the hammer, wherein the maximum handle thickness dimension is measured from a surface of the longitudinal projection on the first side to a surface of a portion of the second side on which the longitudinal recess is not disposed, and wherein a ratio of the maximum handle thickness dimension to the overall handle width dimension is less than 0.4.

15. The hammer of claim 14, wherein the ratio of the maximum handle thickness dimension to the overall handle width dimension is between 0.6 and 0.1.

16. The hammer of claim 14, wherein the head is integrally formed with the upper portion of the handle.

* * * * *